US010329521B2

(12) United States Patent
Zuniga et al.

(10) Patent No.: US 10,329,521 B2
(45) Date of Patent: Jun. 25, 2019

(54) AQUEOUS LIQUID DISHWASHING COMPOSITION COMPRISING AN AMMONIUM ALKYL ETHER SULFATE AND ALKYLAMIDOPROPYL BETAINE

(71) Applicant: COLGATE-PALMOLIVE COMPANY, New York, NY (US)

(72) Inventors: Arturo Zuniga, Del Miguel Hidalgo (MX); Henry Pena, Del Miguel Hidalgo (MX); Reina Espinosa, Del Miguel Hidalgo (MX); Melissa Fleckenstein, Clark, NJ (US); Ram Modh, Egg Harbor Twp, NJ (US); Claudia Bentosa, Del Miguel Hidalgo (MX); Gary Jakubicki, Robbinsville, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/311,546

(22) PCT Filed: May 21, 2014

(86) PCT No.: PCT/US2014/038911
§ 371 (c)(1),
(2) Date: Nov. 16, 2016

(87) PCT Pub. No.: WO2015/178902
PCT Pub. Date: Nov. 26, 2015

(65) Prior Publication Data

US 2017/0121652 A1 May 4, 2017

(51) Int. Cl.

| | |
|---|---|
| ***C11D 11/00*** | (2006.01) |
| ***C11D 1/16*** | (2006.01) |
| ***C11D 1/90*** | (2006.01) |
| ***C11D 1/94*** | (2006.01) |
| ***C11D 3/00*** | (2006.01) |
| ***C11D 1/29*** | (2006.01) |
| ***C11D 1/75*** | (2006.01) |

(52) U.S. Cl.
CPC ..... *C11D 11/0023* (2013.01); *C11D 1/16* (2013.01); *C11D 1/29* (2013.01); *C11D 1/75* (2013.01); *C11D 1/90* (2013.01); *C11D 1/94* (2013.01); *C11D 3/0026* (2013.01); *C11D 3/0094* (2013.01)

(58) Field of Classification Search
CPC ..... C11D 1/29
See application file for complete search history.

(56) References Cited

U.S. PATENT DOCUMENTS

| | | | | |
|---|---|---|---|---|
| 5,290,482 | A | 3/1994 | Marschner et al. | |
| 5,589,447 | A | 12/1996 | Palicka | |
| 5,688,754 | A | 11/1997 | Drapier | |
| 5,714,454 | A | 2/1998 | Thomas | |
| 5,856,291 | A | 1/1999 | Thomas et al. | |
| 5,866,529 | A | 2/1999 | Erilli et al. | |
| 6,069,122 | A * | 5/2000 | Vinson | C11D 3/0094 510/235 |
| 6,152,152 | A * | 11/2000 | Reynen | C11D 1/86 134/25.2 |
| 6,172,021 | B1 * | 1/2001 | Ofosu-Asante | C11D 1/90 510/237 |
| 8,802,607 | B2 | 8/2014 | Fan et al. | |
| 2006/0035807 | A1 * | 2/2006 | Kasturi | A61K 8/44 510/475 |
| 2006/0172908 | A1 | 8/2006 | Everaert et al. | |
| 2008/0233069 | A1 * | 9/2008 | Tamareselvy | A61K 8/8158 424/70.11 |
| 2010/0286011 | A1 * | 11/2010 | Glenn, Jr. | A61K 8/0216 510/120 |
| 2011/0152158 | A1 * | 6/2011 | Bettiol | C11D 1/83 510/237 |
| 2012/0071382 | A1 * | 3/2012 | Wang | C08L 83/08 510/222 |
| 2012/0151881 | A1 * | 6/2012 | Fernandez Prieto | C07C 237/22 53/473 |
| 2012/0308502 | A1 * | 12/2012 | Wise | A61K 8/342 424/70.1 |
| 2013/0174863 | A1 * | 7/2013 | Marsh | A61K 8/365 132/202 |
| 2013/0267451 | A1 | 10/2013 | Hardy | |
| 2014/0271521 | A1 * | 9/2014 | Glenn, Jr. | A61K 8/0216 424/70.122 |
| 2014/0335167 | A1 * | 11/2014 | Panandiker | A61Q 13/00 424/451 |
| 2014/0348884 | A1 * | 11/2014 | Hilvert | A61K 8/891 424/401 |

(Continued)

FOREIGN PATENT DOCUMENTS

| | | |
|---|---|---|
| EP | 0341071 | 11/1989 |
| EP | 0373851 | 6/1990 |

(Continued)

OTHER PUBLICATIONS

International Search Report and Written Opinion for related application No. PCT/US2014/038911 dated Jan. 26, 2015.

*Primary Examiner* — Charles I Boyer

(57) ABSTRACT

Provided herein is an aqueous liquid dishwashing composition comprising i) at least one ethoxylated $C_8$-$C_{18}$ alkyl ether sulfate surfactant having an ethoxylation (EO) of from 0.4 to 1 and ii) at least one $C_8$-$C_{18}$ alkyl amidopropylbetaine surfactant. The ethoxylated $C_8$-$C_{18}$ alkyl ether sulfate surfactant having an ethoxylation (EO) of from 0.4 to 1 and the $C_8$-$C_{18}$ alkyl amidopropylbetaine surfactant act synergistically and provide enhanced foam production, in addition to providing a desirable viscosity, clarity and stability to the composition.

12 Claims, No Drawings

(56) References Cited

U.S. PATENT DOCUMENTS

| | | | | |
|---|---|---|---|---|
| 2015/0148511 | A1* | 5/2015 | Smith | A61K 8/898<br>528/27 |
| 2015/0267150 | A1* | 9/2015 | Chen | C11D 1/94<br>510/237 |
| 2016/0143835 | A1* | 5/2016 | Johnson | A61Q 5/12<br>424/401 |
| 2016/0250115 | A1* | 9/2016 | Li | A61K 8/33<br>510/103 |
| 2016/0338939 | A1* | 11/2016 | Graham | A61K 8/91 |
| 2017/0202765 | A1* | 7/2017 | Marsh | A61K 8/4946 |

FOREIGN PATENT DOCUMENTS

| | | | |
|---|---|---|---|
| EP | 763591 | * | 6/1996 |
| EP | 0763591 | | 12/2000 |
| GB | 2427614 | | 1/2007 |
| WO | 95/07971 | * | 3/1995 |
| WO | WO 1995/007971 | | 3/1995 |
| WO | WO 95/23204 | | 8/1995 |
| WO | WO 97/44423 | | 11/1997 |
| WO | WO 1999/010463 | | 3/1999 |
| WO | WO 1999/019440 | | 4/1999 |
| WO | WO 01/79403 | | 10/2001 |
| WO | WO 02/092743 | | 11/2002 |
| WO | 2007028446 | * | 3/2007 |
| WO | WO 2007/028446 | | 3/2007 |
| WO | 2008074667 | * | 6/2008 |
| WO | WO 2008/074667 | | 6/2008 |
| WO | 2012024076 | * | 2/2012 |
| WO | WO 2012/024076 | | 2/2012 |

* cited by examiner

AQUEOUS LIQUID DISHWASHING COMPOSITION COMPRISING AN AMMONIUM ALKYL ETHER SULFATE AND ALKYLAMIDOPROPYL BETAINE

BACKGROUND

Aqueous liquid dishwashing compositions, for example, hand dishwashing compositions, need to have acceptable levels of foam production in order to be acceptable to the consumer. Foam production is a key attribute for consumers when choosing products, and foam production correlates directly with the consumer's perception of the efficacy of a dishwashing liquid. To achieve a desirable foam mileage (yield), manufacturers incorporate sufficient quantities of active ingredients (for example, surfactants) into compositions.

Dishwashing compositions must also meet consumer standards for clarity and viscosity, and must show stability in the various thermal storage conditions that may be encountered during manufacture, transport and supply. To achieve these properties, additional organic additives are frequently incorporated into the compositions. These include solubilizing alcohol, polymeric additives and hydrotropes.

Surfactants and other organic additives that are incorporated into liquid compositions increase the cost of manufacture of the compositions. Therefore, it would be desirable to provide an aqueous liquid dishwashing composition (for example a hand dishwashing composition), which is acceptable to the consumer, particularly with regard to foam production, viscosity, clarity and stability, yet which has reduced levels of organic material.

BRIEF SUMMARY

The present inventors have unexpectedly found that a surfactant mixture comprising the specific combination of an ethoxylated $C_8$-$C_{18}$ alkyl ether sulfate surfactant having a low ethoxylation (EO) of from 0.4 to 1, and a $C_8$-$C_{18}$ alkyl amidopropylbetaine surfactant, provides an equivalent foam mileage performance to commercial products having up to 10% more surfactant. The ethoxylated $C_8$-$C_{18}$ alkyl ether sulfate surfactant having an ethoxylation (EO) of from 0.4 to 1 and $C_8$-$C_{18}$ alkyl amidopropylbetaine surfactant act synergistically. The present inventors have additionally found that compositions comprising the aforementioned surfactant mixture require lower levels of solubilizing alcohol and other organic additives which are incorporated into conventional formulations to control viscosity, clarity and stability. Thus, the surfactant mixture of the present invention enables consumer acceptability to be maintained with a concurrent reduction in cost.

Accordingly, in a first aspect, the present invention provides an aqueous liquid dishwashing composition comprising i) at least one ethoxylated $C_8$-$C_{18}$ alkyl ether sulfate surfactant having an ethoxylation (EO) of from 0.4 to 1 and ii) at least one $C_8$-$C_{18}$ alkyl amidopropylbetaine surfactant.

Preferably, the at least one ethoxylated $C_8$-$C_{18}$ alkyl ether sulfate surfactant has an ethoxylation (EO) of from 0.4 to 0.8 and more preferably, the at least one ethoxylated $C_8$-$C_{18}$ alkyl ether sulfate surfactant has an ethoxylation (EO) of about 0.6.

Optionally, the at least one ethoxylated $C_8$-$C_{18}$ alkyl ether sulfate surfactant comprises an ammonium or an alkali metal salt of a $C_8$-$C_{18}$ alkyl ether sulfate, and preferably, the at least one ethoxylated $C_8$-$C_{18}$ alkyl ether sulfate surfactant comprises an ammonium salt of a $C_8$-$C_{18}$ alkyl ether sulfate.

Preferably, the at least one ethoxylated $C_8$-$C_{18}$ alkyl ether sulfate surfactant comprises a $C_{10-16}$ alkyl ether sulfate surfactant and more preferably, the at least one ethoxylated $C_8$-$C_{18}$ alkyl ether sulfate surfactant comprises a $C_{12-15}$ alkyl ether sulfate surfactant.

Optionally, the at least one ethoxylated $C_8$-$C_{18}$ alkyl ether sulfate surfactant comprises ammonium lauryl ether sulfate surfactant, ammonium myristyl ether sulfate surfactant or a mixture thereof.

Preferably, the at least one $C_8$-$C_{18}$ alkyl amidopropylbetaine surfactant comprises $C_{10-16}$ alkyl amidopropylbetaine, and more preferably, the at least one $C_8$-$C_{18}$ alkyl amidopropylbetaine surfactant comprises $C_{12-14}$ alkyl amidopropylbetaine.

Optionally, the at least one $C_8$-$C_{18}$ alkyl amidopropylbetaine surfactant comprises laurylamidopropylbetaine, myristylamidopropylbetaine, or a mixture thereof.

Preferably, the total amount of the at least one ethoxylated $C_8$-$C_{18}$ alkyl ether sulfate surfactant and the at least one $C_8$-$C_{18}$ alkyl amidopropylbetaine surfactant is from 6 weight % to 30 weight % by total weight of the composition. More preferably, the total amount of the at least one ethoxylated $C_8$-$C_{18}$ alkyl ether sulfate surfactant and the at least one $C_8$-$C_{18}$ alkyl amidopropylbetaine surfactant is from 15 weight % to 25 weight % by total weight of the composition. Most preferably, the total amount of the at least one ethoxylated $C_8$-$C_{18}$ alkyl ether sulfate surfactant and the at least one $C_8$-$C_{18}$ alkyl amidopropylbetaine surfactant is from 17 weight % to 21 weight % by total weight of the composition. Optionally, the total amount of the at least one ethoxylated $C_8$-$C_{18}$ alkyl ether sulfate surfactant and the at least one $C_8$-$C_{18}$ alkyl amidopropylbetaine surfactant is from 6 weight % to 9 weight % by total weight of the composition.

Optionally, the weight ratio of the at least one ethoxylated $C_8$-$C_{18}$ alkyl ether sulfate surfactant to the at least one $C_8$-$C_{18}$ alkyl amidopropylbetaine surfactant is from 1:3 to 4:1, or from 1:3 to 3:1, or from 1:1 to 3:1, or from 1:1 to 2:1 on a surfactant active ingredient basis. Further optionally, the weight ratio of the at least one ethoxylated $C_8$-$C_{18}$ alkyl ether sulfate surfactant to the at least one $C_8$-$C_{18}$ alkyl amidopropylbetaine surfactant is from 2.75:1 to 4:1 on a surfactant active ingredient basis.

Optionally, the composition is substantially free of surfactants other than the at least one ethoxylated $C_8$-$C_{18}$ alkyl ether sulfate surfactant and the at least one $C_8$-$C_{18}$ alkyl amidopropylbetaine surfactant. Further optionally, the composition comprises surfactants other than at least one ethoxylated $C_8$-$C_{18}$ alkyl ether sulfate surfactant and the at least one $C_8$-$C_{18}$ alkyl amidopropylbetaine surfactant in an amount of 0.5 weight % or less, by total weight of the composition.

Optionally, the composition comprises one or more viscosity modifiers in an amount of less than 3 weight % by total weight of the composition. Further optionally, the viscosity modifier is selected from a $C_1$-$C_5$ alcohol, an ionic salt and a block copolymer. Still further optionally, the $C_1$-$C_5$ alcohol comprises ethanol, and/or the ionic salt comprises one or both of sodium chloride and magnesium sulfate. Preferably, the composition comprises ethanol in an amount of 2 weight % or less, or 1 weight % or less by total weight of the composition.

Optionally, the composition has a viscosity of from 500 to 1200 mPas as measured on a Brookfield RVT Viscometer using spindle 21 at 20 RPM at 25° C. Further optionally, the composition is a light duty hand dishwashing composition.

In a second aspect, provided is a use, in an aqueous liquid dishwashing composition, of a combination of i) at least one ethoxylated $C_8$-$C_{18}$ alkyl ether sulfate surfactant having an ethoxylation (EO) of from 0.4 to 1 and ii) at least one $C_8$-$C_{18}$ alkyl amidopropylbetaine surfactant, for enhancing foam production of the composition.

Optionally, the composition is as defined herein.

In a third aspect, provided is a use, in an aqueous liquid dishwashing composition, of a combination of i) at least one ethoxylated $C_8$-$C_{18}$ alkyl ether sulfate surfactant having an ethoxylation (EO) of from 0.4 to 1 and ii) at least one $C_8$-$C_{18}$ alkyl amidopropylbetaine surfactant, for controlling the viscosity of the composition.

Optionally, the composition is as defined herein.

In a fourth aspect, provided is a use, in an aqueous liquid dishwashing composition, of a combination of i) at least one ethoxylated $C_8$-$C_{18}$ alkyl ether sulfate surfactant having an ethoxylation (EO) of from 0.4 to 1 and ii) at least one $C_8$-$C_{18}$ alkyl amidopropylbetaine surfactant, for inhibiting or preventing gelling of the composition at a temperature below 6° C.

Optionally, the composition is as defined herein.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

In one arrangement, provided is an aqueous liquid composition comprising i) at least one ethoxylated $C_8$-$C_{18}$ alkyl ether sulfate surfactant having an ethoxylation of from 0.4 to 1 and ii) at least one $C_8$-$C_{18}$ alkyl amidopropylbetaine surfactant.

In preferred embodiments, the composition is a dishwashing liquid such as a light duty hand dishwashing liquid.

Ethoxylated $C_8$-$C_{18}$ Alkyl Ether Sulfate Surfactant

The ethoxylated $C_8$-$C_{18}$ alkyl ether sulfate surfactant may be represented by general formula 1:

$$RO(CH_2CH_2O)_xSO_3M \qquad \text{Formula 1:}$$

"R" represents an alkyl group having from 8 to 18 carbon atoms, preferably from 10 to 16 carbon atoms, and more preferably from 12 to 14 carbon atoms. The alkyl group may be linear or branched. The ethoxylated $C_8$-$C_{18}$ alkyl ether sulfate surfactant may comprise or consist of one or a mixture of ethoxylated $C_8$-$C_{18}$ alkyl ether sulfates. Thus, in one embodiment, the ethoxylated $C_8$-$C_{18}$ alkyl ether sulfate surfactant comprises at least one $C_{10-16}$ alkyl ether sulfate surfactant. Preferably, the ethoxylated $C_8$-$C_{18}$ alkyl ether sulfate surfactant comprises at least one $C_{12-15}$ alkyl ether sulfate surfactant. More preferably, the ethoxylated $C_8$-$C_{18}$ alkyl ether sulfate surfactant comprises lauryl ether sulfate surfactant, myristyl ether sulfate surfactant, or a mixture thereof. In some embodiments, the ethoxylated $C_8$-$C_{18}$ alkyl ether sulfate surfactant consists essentially of an ethoxylated $C_{12-15}$ alkyl ether sulfate, lauryl ether sulfate surfactant, myristyl ether sulfate surfactant or a mixture of lauryl ether sulfate surfactant and myristyl ether sulfate surfactant (lauryl/myristyl ether sulfate surfactant).

"x" refers to the average ethoxylation level (referred to hereinafter as "EO"), and represents the average number of moles of ethylene oxide units per mole of alkyl units. In one embodiment, the ethoxylated $C_8$-$C_{18}$ alkyl ether sulfate surfactant has an average ethoxylation (EO) of from 0.4 to 1 or less than 1, from 0.5 to 1 or less than 1, or from 0.6 to 1 or less than 1. Preferably, the ethoxylated $C_8$-$C_{18}$ alkyl ether sulfate surfactant has an EO of from 0.4 to 0.7, from 0.4 to 0.8, from 0.4 to 0.9, from 0.5 to 0.7, from 0.5 to 0.8, from 0.5 to 0.9, from 0.6 to 0.7, from 0.6 to 0.8, or from 0.6 to 0.9. Typically, the ethoxylated $C_8$-$C_{18}$ alkyl ether sulfate surfactant has an EO of 0.6.

"M" is a cation selected from alkali metals (for example, sodium and potassium), alkaline earth metals (for example, calcium and magnesium), ammonium, or substituted ammonium. Specific examples of substituted ammonium cations include methyl-, dimethyl-, trimethyl-ammonium. Other examples of substituted ammonium cations include quaternary ammonium cations, such as tetramethyl-ammonium, dimethyl piperidinium and cations derived from alkanolamines (for example, monoethanolamine, diethanolamine, and triethanolamine, and mixtures thereof). Typically, the ethoxylated $C_8$-$C_{18}$ alkyl ether sulfate surfactant comprises an ammonium or an alkali metal salt.

In a preferred arrangement, the ethoxylated $C_8$-$C_{18}$ alkyl ether sulfate surfactant comprises ammonium lauryl ether sulfate surfactant, ammonium myristyl ether sulfate surfactant, or a mixture thereof (ammonium lauryl/myristyl ether sulfate surfactant). In another arrangement, the ethoxylated $C_8$-$C_{18}$ alkyl ether sulfate surfactant consists essentially of ammonium lauryl ether sulfate surfactant, ammonium myristyl ether sulfate surfactant, or a mixture thereof (ammonium lauryl/myristyl ether sulfate surfactant). In yet another arrangement, the ethoxylated $C_8$-$C_{18}$ alkyl ether sulfate surfactant comprises or consists of sodium lauryl ether sulfate surfactant, sodium myristyl ether sulfate surfactant, or a mixture thereof (sodium lauryl/myristyl ether sulfate surfactant).

The ethoxylated alkyl ether sulfate may be made by sulfating the condensation product of ethylene oxide and $C_{8-18}$ alkanol, and neutralizing the resultant product. The $C_{8-18}$ alkanol is typically reacted with 0.4 to 1 mole ethylene oxide per mole of alkanol, to generate an average EO value of 0.4 to 1. The $C_{8-18}$ alkanol may be derived from plant sources (e.g. coconut or palm oil) which may be "mid-cut" to specifically provide a $C_{12-15}$ alkanol source, or the source of $C_{8-18}$ alkanol may be synthetic. A preferred source is Shell Neodol™ 25 alcohol.

$C_8$-$C_{18}$ Alkyl Amidopropylbetaine

The $C_8$-$C_{18}$ alkyl amidopropylbetaine may be represented by general formula 2:

Formula 2

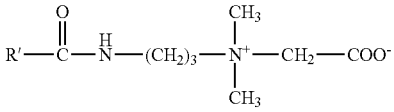

wherein R' represents a linear or branched "$C_nH_{2n+1}$" group, having between 7 and 17 carbons such that the alkyl amidopropylbetaine is a $C_8$-$C_{18}$ alkyl amidopropylbetaine.

The $C_8$-$C_{18}$ alkyl amidopropylbetaine surfactant may comprise or consist of one or a mixture of $C_8$-$C_{18}$ alkyl amidopropylbetaines.

In one embodiment, the $C_8$-$C_{18}$ alkyl amidopropylbetaine comprises cocoamidopropylbetaine or $C_{10}$-$C_{16}$ alkyl amidopropylbetaine. More preferably, the $C_8$-$C_{18}$ alkyl amidopropylbetaine comprises $C_{12}$-$C_{14}$ alkyl amidopropylbetaine or a "mid-cut" $C_{12}$-$C_{14}$ cocoamidopropylbetaine. Most preferably, the $C_8$-$C_{18}$ alkyl amidopropylbetaine comprises laurylamidopropylbetaine (INCI name lauramidopropyl betaine), myristylamidopropyl betaine INCI name myristamidopropyl betaine), or a mixture thereof (lauramidopropyl betaine/myristamidopropyl betaine). In some embodiments, the $C_8$-$C_{18}$ alkyl amidopropylbetaine consists of $C_{12}$-$C_{14}$ alkyl amidopropylbetaine or a "mid-cut" $C_{12}$-$C_{14}$ cocoamidopropylbetaine. In other embodiments, the $C_8$-$C_{18}$ alkyl amidopropylbetaine consists of laurylamidopropylbetaine, myristylamidopropylbetaine, or a mixture thereof.

The present inventors have found that ethoxylated $C_8$-$C_{18}$ alkyl ether sulfate surfactant having an ethoxylation (EO) of from 0.4 to 1, and $C_8$-$C_{18}$ alkyl amidopropylbetaine surfactant, act synergistically to provide an enhanced foam mileage performance (i.e. enhanced foam yield) as compared to other surfactant combinations. This advantageously allows the total amount of surfactant (on a surfactant active ingredient basis) to be reduced.

Thus, in one arrangement, the total amount of the ethoxylated $C_8$-$C_{18}$ alkyl ether sulfate surfactant (EO 0.4 to 1) and the $C_8$-$C_{18}$ alkyl amidopropylbetaine surfactant is from 6 weight % to 30 weight % by total weight of the composition, on a surfactant active ingredient basis. Preferably, the total amount of the ethoxylated $C_8$-$C_{18}$ alkyl ether sulfate surfactant (EO 0.4 to 1) and the $C_8$-$C_{18}$ alkyl amidopropylbetaine surfactant is from 10 weight % to 25 weight %, or from 15 weight % to 25 weight %, or from 20 weight % to 25 weight %, or from 18 weight % to 22 weight %, or from 20 weight % to 22 weight % by total weight of the composition, on a surfactant active ingredient basis. More preferably, the total amount of the ethoxylated $C_8$-$C_{18}$ alkyl ether sulfate surfactant (EO 0.4 to 1) and the $C_8$-$C_{18}$ alkyl amidopropylbetaine surfactant is from 18 weight % to 20 weight % or to 21 weight %, or from 17 weight % to 20 weight % or to 21 weight %, by total weight of the composition, on a surfactant active ingredient basis. In some embodiments, the total amount of the ethoxylated $C_8$-$C_{18}$ alkyl ether sulfate surfactant (EO 0.4 to 1) and the $C_8$-$C_{18}$ alkyl amidopropylbetaine surfactant is 17 weight %, 18 weight %, 19 weight %, 20 weight %, or 21 weight %, by total weight of the composition, on a surfactant active ingredient basis.

In another arrangement, the total amount of the ethoxylated $C_8$-$C_{18}$ alkyl ether sulfate surfactant (EO 0.4 to 1) and the $C_8$-$C_{18}$ alkyl amidopropylbetaine surfactant is from 5 weight % to 10 weight %, or from 6 weight % to 9 weight % by total weight of the composition, on a surfactant active ingredient basis. In some embodiments, the total amount of the ethoxylated $C_8$-$C_{18}$ alkyl ether sulfate surfactant (EO 0.4 to 1) and the $C_8$-$C_{18}$ alkyl amidopropylbetaine surfactant is 6 weight %, 7 weight %, 8 weight %, or 9 weight % by total weight of the composition, on a surfactant active ingredient basis.

Typically, the weight ratio of the ethoxylated $C_8$-$C_{18}$ alkyl ether sulfate surfactant (EO 0.4 to 1) to the $C_8$-$C_{18}$ alkyl amidopropylbetaine surfactant is from 1:3 to 4:1, or from 1:3 to 3:1, or from 1:3 to 2:1 or from 1:3 to 1:1, on a surfactant active ingredient basis. In some embodiments, the weight ratio of the ethoxylated $C_8$-$C_{18}$ alkyl ether sulfate surfactant (EO 0.4 to 1) to the $C_8$-$C_{18}$ alkyl amidopropylbetaine surfactant is from 1:1 to 3:1, or from 1:1 to 2:1, on a surfactant active ingredient basis. In further embodiments, the weight ratio of the ethoxylated $C_8$-$C_{18}$ alkyl ether sulfate surfactant (EO 0.4 to 1) to the $C_8$-$C_{18}$ alkyl amidopropylbetaine surfactant is from 2:1 to 4:1, from 2.25:1 to 4:1, from 2.5:1 to 4:1, from 2.75:1 to 4:1 or from 3:1 to 4:1, on a surfactant active ingredient basis.

In one arrangement, the total amount of the ethoxylated $C_8$-$C_{18}$ alkyl ether sulfate surfactant (EO 0.4 to 1) and the $C_8$-$C_{18}$ alkyl amidopropylbetaine surfactant is from 6 weight % to 9 weight % by total weight of the composition on a surfactant active ingredient basis, and the weight ratio of the ethoxylated $C_8$-$C_{18}$ alkyl ether sulfate surfactant (EO 0.4 to 1) to the $C_8$-$C_{18}$ alkyl amidopropylbetaine surfactant is from 1:1 to 3:1 on an active basis. In a specific embodiment, the total amount of the ethoxylated $C_8$-$C_{18}$ alkyl ether sulfate surfactant (EO 0.4 to 1) and the $C_8$-$C_{18}$ alkyl amidopropylbetaine surfactant is 9 weight % and the weight ratio of the ethoxylated $C_8$-$C_{18}$ alkyl ether sulfate surfactant (EO 0.4 to 1) to the $C_8$-$C_{18}$ alkyl amidopropylbetaine surfactant is from 1:1 to 3:1, on a surfactant active ingredient basis. In another embodiment, the total amount of the ethoxylated $C_8$-$C_{18}$ alkyl ether sulfate surfactant (EO 0.4 to 1) and the $C_8$-$C_{18}$ alkyl amidopropylbetaine surfactant is 8 weight % and the weight ratio of the ethoxylated $C_8$-$C_{18}$ alkyl ether sulfate surfactant (EO 0.4 to 1) to the $C_8$-$C_{18}$ alkyl amidopropylbetaine surfactant is 1.4:1, on a surfactant active ingredient basis.

In another arrangement, the total amount of the ethoxylated $C_8$-$C_{18}$ alkyl ether sulfate surfactant (EO 0.4 to 1) and the $C_8$-$C_{18}$ alkyl amidopropylbetaine surfactant is from 18 weight % to 22 weight %, or from 20 weight % to 22 weight %, or from 20 weight % to 21 weight % by total weight of the composition on a surfactant active ingredient basis, and the weight ratio of the ethoxylated $C_8$-$C_{18}$ alkyl ether sulfate surfactant (EO 0.4 to 1) to the $C_8$-$C_{18}$ alkyl amidopropylbetaine surfactant is from 2.75:1 to 4:1, on a surfactant active ingredient basis. In yet another arrangement, the total amount of the ethoxylated $C_8$-$C_{18}$ alkyl ether sulfate surfactant (EO 0.4 to 1) and the $C_8$-$C_{18}$ alkyl amidopropylbetaine surfactant is from 17 weight % to 22 weight %, or from 17 weight % to 21 weight %, or from 17 weight % to 20 weight % by total weight of the composition on a surfactant active ingredient basis, and the weight ratio of the ethoxylated $C_8$-$C_{18}$ alkyl ether sulfate surfactant (EO 0.4 to 1) to the $C_8$-$C_{18}$ alkyl amidopropylbetaine surfactant is from 2.75:1 to 4:1, on a surfactant active ingredient basis.

Additional Optional Ingredients

The aqueous liquid dishwashing compositions may comprise optional ingredients well known to persons skilled in the art of cleaning compositions such as additional surfactants, hydrotopes, viscosity modifiers, stabilizers, enzymes, dyes, perfumes, and mixtures thereof.

Surfactants

The specific combination of an ethoxylated $C_8$-$C_{18}$ alkyl ether sulfate surfactant (EO 0.4 to 1) and a $C_8$-$C_{18}$ alkyl amidopropylbetaine surfactant effectively provides enhanced foam production and provides cleaning efficacy. As used herein, the term "foam production" refers to one or more of foam mass, foam volume and foam stability. Foam production may be assessed using various methods that would be known to persons skilled in the art of detergent solutions. A specific method of assessing foam production comprises using an automated miniplate tester as described previously in U.S. Pat. No. 4,556,509. This test is described in further detail in the Examples.

Thus, in some embodiments, the total amount of surfactants in the composition other than the ethoxylated $C_8$-$C_{18}$ alkyl ether sulfate surfactant (EO 0.4 to 1) and the $C_8$-$C_{18}$ alkyl amidopropylbetaine surfactant is less than 10 weight %, less than 5 weight %, less than 4 weight %, less than 3 weight %, less than 2 weight %, less than 1 weight % or less than 0.5 weight % by total weight of the composition on a surfactant active ingredient basis. In other embodiments, the aqueous liquid dishwashing composition of the present invention is substantially free of any other surfactants. By "substantially free", it is meant that the total amount of surfactants in the composition other than the ethoxylated $C_8$-$C_{18}$ alkyl ether sulfate surfactant (EO 0.4 to 1) and the $C_8$-$C_{18}$ alkyl amidopropylbetaine surfactant is less than 2 weight %, less than 1 weight % or less than 0.5 weight % by total weight of the composition, on a surfactant active ingredient basis.

If the composition comprises additional surfactants, these may be selected from the group consisting of anionic, nonionic, cationic and amphoteric surfactants. These would be known to the person skilled in the art. However, non-limiting examples are provided below.

Additional anionic surfactants that may be present in the compositions are water soluble and include, but are not limited to, sodium, potassium, ammonium, and ethanolammonium salts of linear $C_8$-$C_{16}$ alkyl benzene sulfonates, alkyl ether carboxylates, $C_{10}$-$C_{20}$ paraffin sulfonates, $C_8$-$C_{25}$ alpha olefin sulfonates, $C_8$-$C_{18}$ alkyl sulfates, and mixtures thereof.

Additional nonionic surfactants that may be present in the compositions include the primary aliphatic alcohol ethoxylates, secondary aliphatic alcohol ethoxylates, alkylphenol ethoxylates, and condensates of ethylene oxide with sorbitan fatty acid esters such as the TWEEN™ surfactants. Other suitable water-soluble nonionic surfactants are marketed under the trade name PLURONIC™. The compounds are formed by condensing ethylene oxide with a hydrophobic base formed by the condensation of propylene oxide with propylene glycol.

Suitable, non-limiting examples of amphoteric detergent surfactants that are useful include derivatives of aliphatic or heterocyclic secondary and ternary amines in which the aliphatic moiety can be straight chain or branched, and in which at least one aliphatic substituent contains an anionic water-solubilizing group. Amine oxides are also suitable amphoteric surfactants which may be incorporated into the compositions of the present invention.

Viscosity Modifiers

The compositions may optionally comprise one or more additional viscosity modifiers or control agents. Such agents include, but are not limited to, polypropylene glycol, linear $C_1$-$C_5$ alcohols such as ethanol, polysorbate 20 (TWEEN™20), polyethylene oxide-polypropylene block copolymers (such as Pluronic™ L44, Pluronic™ L35, or Pluronic™ L31 poloxamers), polyethylene glycol 55 (PEG-55), glycerin, diethylene glycol, GLUCAM™ P-10 propylene glycol ether of methyl glucose with 10 polypropylene oxide units, PLURIOL™ E300 alkoxylates based on ethylene oxide and propylene oxide, sodium cumene sulfonate (SCS), sodium xylene sulfonate (SXS), GLUCAM™ P-20 propylene glycol ether of methyl glucose with 20 polypropylene oxide units, GLUCAM™ E-20 ethylene glycol ether of methyl glucose with 20 polyethylene oxide units, GLUCAM™ E-10 ethylene glycol ether of methyl glucose with 10 polyethylene oxide units, and short chain ethoxylated propoxylated alcohols such as PPG2-Buteth-3, PPG3-Buteth-5, or PPG5-Buteth-7.

The compositions may further comprise one or more ionic additives as viscosity modifiers. The ionic additive may be a salt, which can include any desirable salt. Examples of salts include, but are not limited to, sodium chloride and magnesium sulfate.

The present inventors have unexpectedly found that the specific combination of an ethoxylated $C_8$-$C_{18}$ alkyl ether sulfate surfactant (EO 0.4 to 1) and a $C_8$-$C_{18}$ alkyl amidopropylbetaine surfactant in an aqueous liquid dishwashing composition is effective in providing a desirable viscosity to the composition and obviates the need for large quantities of viscosity modifiers found in conventional dishwashing compositions. In preferred embodiments, the composition has a desirable viscosity of from 500 to 1200 mPas, and more preferably from 600 to 900 mPas, as measured on a Brookfield RVT Viscometer using spindle 21 at 20 RPM at 25° C.

Thus, in one embodiment, the composition comprises one or more viscosity modifiers (the term "viscosity modifier" as used herein is not intended to include ethoxylated $C_8$-$C_{18}$ alkyl ether sulfate surfactant (EO 0.4 to 1) and $C_8$-$C_{18}$ alkyl amidopropylbetaine surfactant), in an amount of less than 5 weight %, less than 4 weight %, less than 3 weight %, or less than 2 weight % by total weight of the composition, optionally, wherein the viscosity modifiers are selected from $C_1$-$C_5$ alcohols, ionic salts, and block copolymers, and further optionally, wherein the $C_1$-$C_5$ alcohol is ethanol, and wherein the ionic salt is sodium chloride and/or magnesium sulfate.

Additionally, whilst ethanol is known to be an effective viscosity enhancer in liquid compositions, ethanol may form an undesirable gel phase at temperatures below 0° C., causing an evident phase separation at the bottom of the container containing the composition. This is undesirable for the consumer. Additionally, a high ethanol content increases the cost of the composition. As the specific combination of an ethoxylated $C_8$-$C_{18}$ alkyl ether sulfate surfactant (EO 0.4 to 1) and a $C_8$-$C_{18}$ alkyl amidopropylbetaine surfactant provides desirable viscosity properties, the amount of ethanol in the compositions may be reduced. Accordingly, in one embodiment, the compositions comprise ethanol in an amount of less than 10 weight %, 5 weight %, 4 weight %, 3 weight %, or 2 weight % or 1 weight % by total weight of the composition. In other embodiments, the compositions comprise ethanol in an amount of less than 1.5 weight % or less than 1.8 weight. % by total weight of the composition. In further embodiments, the compositions are substantially free of ethanol.

Furthermore, unlike conventional viscosity modifiers such as ethanol, the specific combination of an ethoxylated $C_8$-$C_{18}$ alkyl ether sulfate surfactant (EO 0.4 to 1) and a $C_8$-$C_{18}$ alkyl amidopropylbetaine surfactant, whilst providing desirable viscosity properties, does not reduce the stability of the compositions. Thus, typically, the compositions are resistant to gel formation and phase separation at cold temperatures. In some illustrative embodiments, the compositions exhibit stability (as determined by an absence of gel formation or phase separation at 25° C.) having been stored at −4° C., −10° C. or at −30° C. for at least three weeks.

Solvents

The compositions may also contain solvents or salts to modify the cleaning, stability and rheological properties of the composition.

Solvents can include any water soluble solvents. Water soluble solvents include, but are not limited to, $C_{2-4}$ mono, dihydroxy, or polyhydroxy alkanols and/or an ether or diether, such as isopropanol, ethanol, diethylene glycol monobutyl ether, dipropylene glycol methyl ether, diproyleneglycol monobutyl ether, propylene glycol n-butyl ether, propylene glycol, and hexylene glycol, urea, and alkali metal cumene, alkali metal toluene, or alkali metal xylene sulfonates such as sodium cumene sulfonate and sodium xylene sulfonate.

Generally, water is included in the compositions. The amount of water is variable and depends on the amounts of other materials added to the composition. Typically the compositions comprise from 60 weight % to 94 weight % water.

Additional optional ingredients may be included to provide added functional effect or to make the compositions more attractive. Such ingredients include, but are not limited to, perfumes, fragrances, colorants, pigments, dyes, abrasive agents, disinfectants, enzymes, antioxidants, bleaches, chelating agents, antibacterial agents/preservatives, optical brighteners, opacifiers, hydrotropes, or combinations thereof. These ingredients would be known to persons skilled in the art of cleaning liquid manufacture.

The compositions can be made by simple mixing methods from readily available components which, on storage, do not adversely affect the entire composition. Mixing can be done by any mixer that forms the composition. Examples of mixers include, but are not limited to, static mixers and in-line mixers.

The composition can be provided in any type and shape of container that is compatible with the composition. Non-limiting examples of containers are made from plastic or glass. For consumer convenience, plastic may be chosen. The plastic can be any type of plastic. Examples of plastic include, but are not limited to, polyethylene tetra phthalate (PET), polyethylene, polypropylene, or polyvinyl chloride. Container properties, such as clarity, gloss, color, and shape can be selected to provide a desired aesthetic effect.

Uses

The compositions defined herein are suitable for use as dishwashing liquids, and in particular, light duty hand dishwashing liquids. In some embodiments, the compositions defined herein may also be suitable for cleaning other hard surfaces (such as glass, metal and the like).

As demonstrated in the following examples, the present inventors have unexpectedly found that the specific combination of an ethoxylated $C_8$-$C_{18}$ alkyl ether sulfate surfactant having an ethoxylation (EO) of from 0.4 to 1 and a $C_8$-$C_{18}$ alkyl amidopropylbetaine surfactant is effective in enhancing foam production at a lower surfactant active ingredient level, as compared to other surfactant compositions. The inventors have further found that the incorporation of the specific combination of an ethoxylated $C_8$-$C_{18}$ alkyl ether sulfate surfactant having an ethoxylation (EO) of from 0.4 to 1 and a $C_8$-$C_{18}$ alkyl amidopropylbetaine surfactant into aqueous liquid compositions is effective in modulating the viscosity of the compositions, thus obviating the need for additional viscosity control agents.

Accordingly, further provided is a use, in an aqueous liquid dishwashing composition, of a combination of i) at least one ethoxylated $C_8$-$C_{18}$ alkyl ether sulfate surfactant having an ethoxylation (EO) of from 0.4 to 1 and ii) at least one $C_8$-$C_{18}$ alkyl amidopropylbetaine surfactant, for enhancing foam production of the composition. The composition may be as defined herein.

There is additionally provided a use, in an aqueous liquid dishwashing composition, of a combination of i) at least one ethoxylated $C_8$-$C_{18}$ alkyl ether sulfate surfactant having an ethoxylation (EO) of from 0.4 to 1 and ii) at least one $C_8$-$C_{18}$ alkyl amidopropylbetaine surfactant, for controlling (for example, decreasing) the viscosity of the composition. The composition may be as defined herein.

The present inventors have additionally found that in the presence of the specific combination of an ethoxylated $C_8$-$C_{18}$ alkyl ether sulfate surfactant having an ethoxylation (EO) of from 0.4 to 1 and a $C_8$-$C_{18}$ alkyl amidopropylbetaine surfactant, fewer additives are required to maintain composition stability (i.e. preventing gelling and/or phase separation and maintaining viscosity over time) at low temperatures (for example, below 6° C.).

Accordingly, further provided is a use, in an aqueous liquid dishwashing composition, of a combination of i) at least one ethoxylated $C_8$-$C_{18}$ alkyl ether sulfate surfactant having an ethoxylation (EO) of from 0.4 to 1 and ii) at least one $C_8$-$C_{18}$ alkyl amidopropylbetaine surfactant, for inhibiting or preventing gelling and/or phase separation of the composition, and/or for improving the stability of the composition, at a temperature below 6° C.

EXAMPLES

The following examples illustrate compositions of the invention. Unless otherwise specified, all percentages are by weight. The abbreviation "AI" refers to the total amount of surfactant active ingredient(s). The exemplified compositions are illustrative and do not limit the scope of the invention.

Example 1—Foam Production (1)

The foaming potential of a formula comprising ammonium $C_{12-15}$ alkyl ether sulfate surfactant (AEOS) (0.6 EO) and lauramidopropyl betaine/myristamidopropyl betaine in a weight ratio of 4:1, and in a total (active) amount of 20 weight %, was tested against a comparative product comprising AEOS (0.6 EO) and lauramidopropyl amine oxide/myristamidopropyl amine oxide in a total (active) amount of 22.25 weight %. Foam production was determined using a SITA Foam Tester R-2000 which specifically measures foam volume as produced by the relevant test solution in the presence of soil. (The readout obtained from a SITA analyzer is "foam end-point" (foam EP). The higher the foam EP, the greater the foam volume.) The compositions tested are indicated in Table 1 and the results are illustrated in Table 2.

TABLE 1

| Compositions tested | | | |
|---|---|---|---|
| | % AI | Comparative Product Weight % (As is) | Prototype 1 Weight % (As is) |
| Alcoholethoxysulfate (0.6 EO) NH4 salt | 71 | 24.5% | 22.53% |
| Alcoholethoxysulfate (1.3 EO) NH4 salt | 70.7 | — | — |
| LaurylMyristalamido-propylamine oxide | 33.04 | 14.74% | — |
| LaurylMyristalamido-propylbetaine | 31.4 | — | 12.74% |
| SD 3A Alcohol | 100 | 6.9% | 6.9% |
| Pluronic L44 | 100 | 0.3% | 0.3% |
| Water and minors (colors, fragrances, salts, and preservatives) | 100 | Q.S. | Q.S. |
| | Total Ingredient | 100% | 100% |
| | Total Surfactant Active | 22.25 | 20 |

pH adjusted to 7.2 with sulfuric acid/QS water

TABLE 2

| Foam production results | | |
|---|---|---|
| | SITA Foam EP | STD Dev |
| Comparative Product | 28.3 | 2.1 |
| Prototype 1 | 28.0 | 1 |

It can be seen from Table 2 that the foam volume for the two formulations were unexpectedly equivalent even though the total amount of active surfactant in the comparative product was greater than 10 weight % less (and even higher on a molar basis), as compared to the prototype formulation. Thus it can be concluded that the combination of an ethoxylated alkyl ether sulfate surfactant with a low (≤1) ethoxylation level and an alkyl amidopropylbetaine surfactant, in accordance with the present invention, effectively enhances foam activity.

Example 2—Foam Production (2)

Further compositions according to the present invention were prepared, and their foam production was compared to compositions comprising AEOS with a high ethoxylation (1.3) in place of AEOS with a low ethoxylation (0.6), and/or lauramidopropyl amine oxide/myristamidopropyl amine oxide surfactant in place of the lauramidopropyl betaine/myristamidopropyl betaine surfactant. The compositions tested are indicated in Table 3. As can be seen from Table 3, two systems were evaluated. In the first system, the total amount of surfactant active ingredients present was 22.25 weight % and the (active) weight ratio of the alkyl ether sulfate surfactant to the amphoteric surfactant was 3.57:1. In the second system, the total amount of surfactant actives present was 27.3 weight % and the (active) weight ratio of the alkyl ether sulfate surfactant to the amphoteric surfactant was 3.96:1. Foam production was assessed using both SITA, as described in Example 1, and an automated "miniplate" tester. The "miniplate" test has been described previously in U.S. Pat. No. 4,556,509. Briefly, the test is used to determine the number of "miniplates" that can theoretically be washed in a given detergent solution, in the presence of soil, until the foam disappears. In the test, foam is generated by the relevant detergent solution by means of an agitating bush, and soil is added to the detergent solution at a steady state. Foam production is measured electronically by reflectance of the solution surface. The disappearance of the foam determines the endpoint of the test, and the number of "miniplates" that could theoretically be washed is then calculated based on the foam duration and rate of soil addition. The results are illustrated in Tables 4, 5 and 6.

TABLE 3

| compositions tested | | | | | | | | | |
|---|---|---|---|---|---|---|---|---|---|
| | Ingred. % AI | A Wt. % (As is) 0.6 AO | B Wt. % (As is) 0.6 Bet | C Wt. % (As is) 1.3 AO | D Wt. % (As is) 1.3 Bet | E Wt. % (As is) 0.6 AO | F Wt. % (As is) 0.6 Bet | G Wt. % (As is) 1.3 AO | H Wt. % (As is) 1.3 Bet |
| Alcoholethoxysulfate (0.6 EO) NH4 salt | 71 | 24.5 | 24.5 | — | — | 30.74 | 30.74 | — | — |
| Alcoholethoxysulfate (1.3 EO) NH4 salt | 70.7 | — | — | 24.58 | 24.58 | — | — | 30.83 | 30.83 |
| LaurylMyristalamido-propylamine oxide | 33.04 | 14.74 | — | 14.74 | — | 16.65 | — | 16.65 | — |
| LaurylMyristalamido-propylbetaine | 31.4 | — | 15.5 | — | 15.5 | — | 17.5 | — | 17.5 |
| SD 3A Alcohol | 100 | — | — | — | — | 6.6 | 6.6 | 6.6 | 6.6 |
| Pluronic L44 EO-PO copolymer | 100 | — | — | — | — | — | — | — | — |
| Water and minors (colors, fragrances, salts, and preservatives) | 100.00 | Q.S. | Q.S. | Q.S. | Q.S. | Q.S. | Q.S. | Q.S. | Q.S. |
| | Total | 100.0 | 100.0 | 100.0 | 100.0 | 100.0 | 100.0 | 100.0 | 100.0 |
| | Total Surf't Active | 22.25 | 22.25 | 22.25 | 22.25 | 27.3 | 27.3 | 27.3 | 27.3 |

pH adjusted to 7.2 with sulfuric acid/QS water

TABLE 4

| SITA results for formulae A, B, C and D | | | | |
|---|---|---|---|---|
| Product | AO 0.6EO | AO 1.3EO | Bet 0.6EO | Bet 1.3EO |
| Formula | A | C | B | D |
| Average | 28.4 | 27.6 | 31.0 | 30.6 |

TABLE 5

| SITA results for formulae E, F, G and H | | | | |
|---|---|---|---|---|
| Product | AO 0.6EO | AO 1.3EO | Bet 0.6EO | Bet 1.3EO |
| Formula | E | G | F | H |
| Average | 37.6 | 37.8 | 41.2 | 41.6 |

TABLE 6

| Miniplate testing results for formulae A, B, C and D | | | | |
|---|---|---|---|---|
| Product | AO 0.6EO | AO 1.3EO | Bet 0.6EO | Bet 1.3EO |
| Formula | A | C | B | D |
| Average MP | 30.7 | 27.3 | 38.2 | 30.6 |

TABLE 7

| Miniplate testing results for formulae E, F, G and H | | | | |
|---|---|---|---|---|
| Product | AO 0.6EO | AO 1.3EO | Bet 0.6EO | Bet 1.3EO |
| Formula | E | G | F | H |
| Average MP | 38.7 | 35.3 | 41.7 | 37.1 |

As seen in Tables 4 and 5 which illustrate the SITA testing results, the compositions comprising the AEOS/betaine combination (compositions B, D, F and H) perform better than the corresponding AEOS/amine oxide formulations (compositions A, C, E, G) at both total active ingredient levels tested. Thus it may be concluded that the AEOS/betaine combination of the present invention advantageously allows the total amount of active surfactant ingredient to be reduced, whilst maintaining foam production.

As seen in Tables 6 and 7 which illustrate the "miniplate" foam mileage test results, compositions according to the present invention comprising AEOS (0.6 EO) and lauramidopropyl betaine/myristamidopropyl betaine (compositions B and F) unexpectedly perform significantly better than the other control compositions comprising AEOS (1.3 EO) and lauramidopropyl amine oxide/myristamidopropyl amine oxide (compositions C and G), or compositions comprising AEOS (0.6 EO) and lauramidopropyl amine oxide/myristamidopropyl amine oxide (compositions A and E), or compositions comprising AEOS (1.3 EO) and lauramidopropyl betaine/myristamidopropyl betaine (compositions D and H). The results demonstrate a synergy between AEOS (0.6 EO) and the alkyl amidopropylbetaine at both total active ingredient levels tested.

Example 3—Requirement for Additives

Liquid detergent compositions generally comprise solubilizing alcohol such as ethanol and/or polymeric additives to provide and maintain a desirable viscosity for the consumer, whilst preventing undesired gelling/phase separation at low temperatures. However, these additives increase the cost of compositions. In order to assess the requirement for such additives, various amounts of additives were incorporated into compositions according to the present invention and into control compositions, and their effects on viscosity and stability at cold temperatures were determined. Viscosity was measured using a Brookfield RVT Viscometer using spindle 21 at 20 RPM at 25° C. Stability was measured by decreasing the temperature of the relevant composition by means of a cooling bath, and visually monitoring the turbidity composition. The temperature at which the composition first becomes turbid represents the "cloud point".

The compositions tested are indicated in Table 8.

TABLE 8

| compositions tested | | | | | | | | |
|---|---|---|---|---|---|---|---|---|
| | Ingred. % AI | A1 Weight % (As is) 0.6 AO | B1 Weight % (As is) 0.6 Bet | B2 Weight % (As is) 0.6 Bet | B3 Weight % (As is) 0.6 Bet | C1 Weight % (As is) 1.3 AO | D1 Weight % (As is) 1.3 Bet | D2 Weight % (As is) 1.3 Bet |
| Alcoholethoxysulfate (0.6 EO) NH4 salt | 71 | 24.5 | 24.5 | 24.5 | 24.5 | — | — | — |
| Alcoholethoxysulfate (1.3 EO) NH4 salt | 70.7 | — | — | — | — | 24.6 | 24.6 | 24.6 |
| LaurylMyristalamido-propylamine oxide | 33.04 | 14.74 | — | — | — | 14.74 | — | — |
| LaurylMyristalamido-propylbetaine | 31.4 | | 15.5 | 15.5 | 15.5 | | 15.5 | 15.5 |
| SD 3A Alcohol | 100 | 1.5 | 1 | 1 | 1 | 1.5 | 1 | 1 |
| Pluronic L44 EO-PO copolymer | 100 | 1.5 | — | — | — | 1.5 | — | |
| Water and minors (colors, fragrances, salts and preservatives) | 100 | Q.S. | Q.S. | Q.S. | Q.S. | Q.S. | Q.S. | Q.S. |
| | Total Ingredient | 100 | 100 | 100 | 100 | 100 | 100 | 100 |
| | Total Surfactant Active | 22.25 | 22.25 | 22.25 | 22.25 | 22.25 | 22.25 | 22.25 |
| | Cloud point | 5/6 | 7/8 | 7/8 | 6.5/7 | 4.5/5 | 7/7.5 | 5/5.5 |

TABLE 8-continued

| compositions tested | | | | | | | |
|---|---|---|---|---|---|---|---|
| Ingred. % AI | A1 Weight % (As is) 0.6 AO | B1 Weight % (As is) 0.6 Bet | B2 Weight % (As is) 0.6 Bet | B3 Weight % (As is) 0.6 Bet | C1 Weight % (As is) 1.3 AO | D1 Weight % (As is) 1.3 Bet | D2 Weight % (As is) 1.3 Bet |
| Viscosity (cps) | 788 | 4465 | 985 | 765 | 1433 | 14460 | 1867 |

pH adjusted to 7.2 with sulfuric acid/QS water

The comparative composition comprising AEOS (0.6 EO) and lauramidopropyl amine oxide/myristamidopropyl amine oxide (composition Al) required 1.5% ethanol, 1.5% Pluronic L44 and 1.5 NaCl to achieve a consumer-desirable viscosity of 750 mPas, and a cloud point of less than 6° C. When the amine oxide is substituted for by the corresponding betaine in accordance with the present invention, ethanol in an amount of only 1 weight %, and NaCl in an amount of only 1.35 weight % (with no Pluronic L44) is required to achieve a comparable viscosity and stability (see composition B3). This amounts to a 66% reduction in additives.

Example 4—Ratio of Anionic:Betaine Surfactant—Foam Production

The foam activity of two compositions according to the present invention was tested using the SITA test and Miniplate test as described above. The weight ratio of AEOS (0.6 EO) to lauramidopropyl betaine/myristamidopropyl betaine (on a surfactant active ingredient basis) in these compositions was 4:1 and 2.75:1, respectively. The total amount of surfactant (on a surfactant active ingredient basis) was approximately 20 weight % in both compositions. The compositions are indicated in Table 9 and the results are illustrated in Tables 10 and 11. The foam production of the compositions of the present invention was tested against a control composition comprising AEOS (0.6 EO) and lauramidopropyl amine oxide/myristamidopropyl amine oxide, as indicated in Table 1.

TABLE 9

| compositions tested | | | |
|---|---|---|---|
| | Ingred. % AI | I Weight % (As is) Bet 4:1 CT | J Weight % (As is) Bet 2.75:1 CT |
| Alcoholethoxysulfate (1.3EO) NH4 salt | 70 | — | — |
| Alcoholethoxysulfate (0.6EO) NH4 salt | 70 | 23.4% | 20.95% |
| LaurylMyristalamido-propylamine oxide | 33 | — | — |
| LaurylMyristalamido-propylbetaine | 30 | 13.67% | 17.8% |
| SD 3A Alcohol | 100 | 5.8% | 6.9% |
| Pluronic L44 | 100 | 0.3% | 0.3% |
| Water and minors (colors, fragrances, salts, and preservatives) | 100 | Q.S. | Q.S. |
| | Total Ingredient | 100% | 100% |

TABLE 9-continued

| compositions tested | | |
|---|---|---|
| Ingred. % AI | I Weight % (As is) Bet 4:1 CT | J Weight % (As is) Bet 2.75:1 CT |
| Total Surfactant Active | 20.5 | 20 |
| Cloud point | 5-7 | 5-7 |
| Viscosity (cps) | 650 | 650 |

pH adjusted to 7.2 with sulfuric acid/QS water

TABLE 10

| SITA results | | | |
|---|---|---|---|
| Product | Control | 4:1 Betaine CT | 2.75:1 Betaine CT |
| Average SITA EP | 32.1 | 31.3 | 34.4 |

TABLE 11

| "Miniplate" Results | | | |
|---|---|---|---|
| Product | Control | 4:1 Bet | 2.75:1 Bet |
| Average MP EP | 31 | 30.5 | 31.4 |

As seen in Table 10, the "2.75:1" formula showed a better performance on the SITA test, as compared to the "4:1" formulation. Both formulae performed better than the control composition which contained approximately 10 weight % more surfactant, on an active ingredient basis. Table 11 indicates that all formulations tested performed comparably on the "Miniplate" assay despite the higher surfactant active ingredient concentration of the control formulation.

Example 5—Hand Dishwashing Neat Evaluation

A hand dishwashing test was also performed using the compositions indicated in Table 8. Briefly, in this test a sponge is rinsed with hot water and wrung out repeatedly until no foam is seen (this process removes the silicon film present on the sponge). 2 g of the relevant dishwashing composition are then added to the sponge in a "figure of 8" pattern. Plates are soiled with 2 g of soil using a circular motion, and the sponge is then pressed against each plate and moved in a circular motion to clean the plate. Small amounts of water are used to moisten the plate/sponge as needed. The number of plates that can be washed without further addition of the dishwashing composition, is recorded.

As seen in Table 12 below, both the "2.75:1" and "4:1" formulae performed comparably to the control formulation containing AEOS (EO 0.6) and lauramidopropyl amine oxide/myristamidopropyl amine oxide surfactant in a (higher) total amount of 22.25 weight % (on a surfactant active ingredient basis) (see Table 1 for composition of control formulation).

TABLE 12 hand dishwashing results

| Product | Current | 4:1 Bet | 2.75:1 Bet |
|---|---|---|---|
| Average Dishes | 10.44 | 10.54 | 10.48 |

Example 6—User Tests

A user test was conducted to determine whether compositions of the present invention comprising AEOS (0.6 EO) and lauramidopropyl betaine/myristamidopropyl betaine (as provided in Table 8) had any advantage over a control composition comprising AEOS (0.6 EO) and lauramidopropyl amine oxide/myristamidopropyl amine oxide in a total active amount of 22.25 weight %. Scores were provided based on thickness of suds produced, amount of suds produced, duration of suds, and overall effectiveness. The results are provided in Table 13.

TABLE 13 user test results

| | Comparative (A) | Formula 4:1 (B) | Formula 2.75:1 (C) |
|---|---|---|---|
| Base Total | (153) | (153) | (153) |
| Overall Preference | 317 | 304 | 297 |
| Overall Preference | 321 | 314 | 282 |
| Suds Amount | | | |
| Base Total | (51) | (52) | (50) |
| Overall Liking | 43% | 40% | 46% |
| | 6.6 | 6.8 | 6.9 |
| Overall Effectiveness | 73% | 76% | 86% |
| | 4.1 | 4.1 | 4.3 |
| Makes Thick Rich Suds | 57% | 58% | 66% |
| | 3.6 | 3.7 | 3.9 |
| Amount of Suds | 65% | 73% | 80% |
| | 2.9 | 2.9 | 3.0 |
| Length Suds Lasted | 63% | 67% | 76% |
| | 2.8 | 2.8 | 2.9 |

It can be seen from Table 13 that overall, both compositions tested were at least equivalent in efficacy and in foaming attributes to the comparative product having a higher level of surfactant actives. The "2.75:1" formulation was considered to have better foaming attributes, relative to the "4:1" formulation. Thus, despite a lower total surfactant active concentration as compared to the comparative product, the two compositions of the present invention were deemed acceptable in the user test.

Example 7—Final Formulations

The two formulations according to the present invention provided in Table 9 were adapted to include appropriate quality control additives for an acceptable consumer product. Table 14 indicates the adapted formulations. Table 15 indicates the viscosity, clarity and stability properties of these formulations. Viscosity is measured using a Brookfield RVT Viscometer using spindle 21 at 20 RPM at 25° C. Stability was measured by a visual assessment of turbidity as a function of temperature, as described in Example 3.

TABLE 14

Formulations according to the present invention adapted for consumer use

| Name | Comparative (As-Is) | Formula Betaine 4:1 (As-Is) | Formula Betaine 2.75:1 (As-Is) |
|---|---|---|---|
| WATER and minors (color, fragrance, salts, preservatives) | Q.S. | Q.S. | Q.S. |
| SO3 EAS N25 0.6EO NH4 - 70% | 24.83 | 23.43 | 20.95 |
| LAURYL/MYRISTYL-AMIDOPROPYL DIMETHYLAMINE OXIDE - 33% | 14.75 | 0 | 0 |
| MAGNESIUM SULFATE - 25% SOLUTION | 2 | 3 | 2 |
| PLURONIC L-44 EO-PO polymer 100% | 0.3 | 0.3 | 0 |
| SD 3A Alcohol 100% | 6.9 | 1.0 | 1.75 |
| LAURYLAMIDO-PROPYL BETAINE - 30% | 0 | 13.67 | 17.8 |
| Surfactant AI | 22.25% | 20.5% | 20% |

TABLE 15

Physical properties of formulations according to the present invention

| | Formula | |
|---|---|---|
| Property | Formula Betaine 4:1 | Formula Betaine 2.75:1 |
| pH | 6.9 | 7.2 |
| Cloud Point (° C.) | 8.0 | 8.5 |
| Viscosity (cps) | 650 | 520 |
| Viscosity after 8 wks (cps) | 680 | 590 |
| Appearence | translucent liquid, No gel detected | translucent liquid, No gel detected |
| −30° C. after 3 wks | translucent liquid, No gel detected | translucent liquid, No gel detected |
| −10° C. after 3 wks | translucent liquid, No gel detected | translucent liquid, No gel detected |

It can be seen from Tables 14 and 15 that the "2.75:1" formulation requires only 1.75 weight % ethanol (SD 3A alcohol) and no Pluronic-L44 (viscosity modifier), corresponding a total amount of additives of 1.75 weight %, to achieve a viscosity, clarity and cold temperature stability acceptable for the consumer, The "4:1" formulation requires only 1 weight % ethanol and 0.3 weight % Pluronic-L44, corresponding a total amount of additives of 1.3 weight %, to achieve a viscosity, clarity and cold temperature stability acceptable for the consumer. In contrast, the comparative control formulation which comprises AEOS (0.6 EO) and lauramidopropyl amine oxide/myristamidopropyl amine oxide, requires 6.9 weight % ethanol and 0.3 weight % Pluronic L44 for consumer acceptability, corresponding to a total amount of additives of 7.2 weight %.

Example 8—Reducing Level of Surfactant Actives

In order to determine whether the total concentration of active surfactant ingredients could be reduced in the formulations of the present invention, whilst maintaining effective foam production, the foam activity of various formulations comprising AEOS (0.6 EO) and laurylamidopropylbetaine in a total amount of between 6 and 9 weight % (on a surfactant active ingredient basis) were tested using the standard "miniplate" test. The results are indicated in Table 16.

TABLE 16

| Foam activity of formulations comprising between 6 and 9 weight % surfactant actives | | | |
|---|---|---|---|
| ALES 0.6EO | Betaine | Amount | MP |
| 0 | 6 | 6 | 3.36 |
| 6 | 0 | 6 | 9.94 |
| 4.5 | 1.5 | 6 | 12.84 |
| 1.5 | 4.5 | 6 | 14.11 |
| 3 | 3 | 6 | 13.55 |
| 9 | 0 | 9 | 12.91 |
| 0 | 9 | 9 | 5.58 |
| 6.75 | 2.25 | 9 | 19.68 |
| 2.25 | 6.75 | 9 | 21.75 |
| 4.5 | 4.5 | 9 | 24.65 |
| Comparative formula | | | |
| ALES 0.6 EO | LMDO | Amount | MP |
| 6.36 | 2.89 | 9.25 | 19.45 |

It can be seen from Table 16 that effective foam activity (MP) is observed at a total surfactant active concentration as low as 9 weight %, when the weight ratio of AEOS (0.6 EO) to laurylamidopropylbetaine is from 1:3 to 3:1. The foam activity observed at these concentrations/ratios is improved over a comparative composition comprising AEOS (0.6 EO) and lauryl/myristyl amine oxide in a total active amount of approximately 9 weight %. Effective foam activity is also observed at a total surfactant active concentration as low as 6 weight %, when the weight ratio of AEOS (0.6 EO) to laurylamidopropylbetaine is from 1:1 to 1:3. An exemplary formulation according to the present invention comprising a total surfactant active amount of 8 weight % is illustrated in Table 17.

TABLE 17

| exemplary formulation comprising a low level of surfactant actives | | |
|---|---|---|
| | Comparative (%) (As-Is) | Formula Betaine 1.4:1 (%) (As-Is) |
| Water and minors (color, fragrance, salts, preservative) | Q.S. | Q.S. |
| SO3 EAS N25 0.6EO - 70% | 9.1 | 6.6 |
| LAURYL/MYRISTYL-AMIDOPROPYL DIMETHYLAMINE OXIDE 33% | 8.76 | 0 |
| PLURONIC L-44 EO-PO polymer 100% | 0.5 | 0 |
| LAURYLAMIDOPROPYL BETAINE - 30% | 0 | 11.4 |
| Total AI | 9.25% | 8.0% |

What is claimed is:

1. An aqueous liquid dishwashing composition comprising i) at least one ethoxylated $C_8$-$C_{18}$ alkyl ether sulfate surfactant having an ethoxylation (EO) of from 0.4 to 0.8 and ii) at least one $C_8$-$C_{18}$ alkyl amidopropylbetaine surfactant, wherein the at least one ethoxylated $C_8$-$C_{18}$ alkyl ether sulfate surfactant comprises an ammonium salt of a $C_8$-$C_{18}$ alkyl ether sulfate, wherein the total amount of the at least one ethoxylated $C_8$-$C_{18}$ alkyl ether sulfate surfactant and the at least one $C_8$-$C_{18}$ alkyl amidopropylbetaine surfactant is from 6 weight % to 30 weight % by total weight of the composition, wherein the total amount of surfactants other than the at least one ethoxylated $C_8$-$C_{18}$ alkyl ether sulfate surfactant and the at least one $C_8$-$C_{18}$ alkyl amidopropylbetaine surfactant is less than 1 weight % by total weight of the composition, wherein the weight ratio of the at least one ethoxylated $C_8$-$C_{18}$ alkyl ether sulfate surfactant to the at least one $C_8$-$C_{18}$ alkyl amidopropylbetaine surfactant is from 2.5:1 to 4:1, wherein the composition comprises one or more viscosity modifiers in an amount of less than 3 weight % by total weight of the composition, and wherein the aqueous liquid dishwashing composition has a viscosity from 500 to 1200 mPas as measured on a Brookfield RVT Viscometer using spindle 21 at 20 RPM at 25° C.

2. The composition of claim 1, wherein the at least one ethoxylated $C_8$-$C_{18}$ alkyl ether sulfate surfactant comprises ammonium lauryl ether sulfate surfactant, ammonium myristyl ether sulfate surfactant or a mixture thereof.

3. The composition of claim 1, wherein the at least one $C_8$-$C_{18}$ alkyl amidopropylbetaine surfactant comprises at least one of $C_{10-16}$ alkyl amidopropylbetaine and $C_{12-14}$ alkyl amidopropylbetaine.

4. The composition of claim 1, wherein the at least one $C_8$-$C_{18}$ alkyl amidopropylbetaine surfactant comprises laurylamidopropylbetaine, myristylamidopropylbetaine, or a mixture thereof.

5. The composition of claim 1, wherein the weight ratio of the at least one ethoxylated $C_8$-$C_{18}$ alkyl ether sulfate surfactant to the at least one $C_8$-$C_{18}$ alkyl amidopropylbetaine surfactant is from 2.75:1 to 4:1.

6. The composition of claim 1, wherein the composition is substantially free of surfactants other than the at least one ethoxylated $C_8$-$C_{18}$ alkyl ether sulfate surfactant and the at least one $C_8$-$C_{18}$ alkyl amidopropylbetaine surfactant.

7. The composition of claim 1, wherein a total amount of surfactants other than at least one ethoxylated $C_8$-$C_{18}$ alkyl ether sulfate surfactant and the at least one $C_8$-$C_{18}$ alkyl amidopropylbetaine surfactant in the composition is 0.5 weight % or less, by total weight of the composition.

8. The composition of claim 1, wherein the viscosity modifier is selected from a $C_1$-$C_5$ alcohol, an ionic salt and a block copolymer.

9. The composition of claim 8, wherein the $C_1$-$C_5$ alcohol comprises ethanol, and optionally, wherein the ionic salt comprises sodium chloride and/or magnesium sulfate.

10. The composition of claim 1 further comprising ethanol in an amount of 2 weight % or less, by total weight of the composition.

11. The composition of claim 1 which is a light duty hand dishwashing composition.

12. A method for enhancing foam production of an aqueous liquid dishwashing composition, controlling the viscosity of the composition, or inhibiting or preventing gelling of the composition at a temperature below 6° C., comprising incorporating a combination into the composition;

wherein the combination includes i) at least one ethoxylated $C_8$-$C_{18}$ alkyl ether sulfate surfactant having an ethoxylation (EO) of from 0.4 to 0.8 and ii) at least one $C_8$-$C_{18}$ alkyl amidopropylbetaine surfactant; and wherein the at least one ethoxylated $C_8$-$C_{18}$ alkyl ether sulfate surfactant comprises an ammonium salt of a $C_8$-$C_{18}$ alkyl ether sulfate, wherein the total amount of the at least one ethoxylated $C_8$-$C_{18}$ alkyl ether sulfate surfactant and the at least one $C_8$-$C_{18}$ alkyl amidopropylbetaine surfactant is from 6 weight % to 30 weight % by total weight of the composition, wherein the total amount of surfactants other than the at least one ethoxylated $C_8$-$C_{18}$ alkyl ether sulfate surfactant and the at least one $C_8$-$C_{18}$ alkyl amidopropylbetaine surfactant is less than 1 weight % by total weight of the composition, wherein the weight ratio of the at least one ethoxylated $C_8$-$C_{18}$ alkyl ether sulfate surfactant to the at least one $C_8$-$C_{18}$ alkyl amidopropylbetaine surfactant is from 2.5:1 to 4:1, wherein the composition comprises one or more viscosity modifiers in an amount of less than 3 weight % by total weight of the composition, and wherein the aqueous liquid dishwashing composition has a viscosity from 500 to 1200 mPas as measured on a Brookfield RVT Viscometer using spindle 21 at 20 RPM at 25° C.

* * * * *